United States Patent [19]

Thimmesch

[11] Patent Number: 4,971,576

[45] Date of Patent: Nov. 20, 1990

[54] MODULAR POWER CORD SYSTEM

[75] Inventor: Jan P. Thimmesch, Eden Prairie, Minn.

[73] Assignee: The Budd Company, Troy, Mich.

[21] Appl. No.: 431,293

[22] Filed: Nov. 3, 1989

[51] Int. Cl.[5] ..... H01R 11/00

[52] U.S. Cl. ..... 439/502; 439/34; 219/205

[58] Field of Search ..... 439/34, 36, 502–505; 219/205

[56] References Cited

U.S. PATENT DOCUMENTS

| | | | |
|---|---|---|---|
| 1,759,389 | 5/1930 | Bowen | 219/205 |
| 2,067,102 | 1/1937 | Simon | 219/38 |
| 2,070,635 | 2/1937 | White | 219/38 |
| 3,171,015 | 2/1965 | Grinde | 219/205 |
| 3,251,017 | 5/1966 | Okerstrom | 338/229 |
| 3,504,169 | 3/1970 | Freeburger | 240/10 |
| 4,026,621 | 3/1977 | Korba | 439/502 |
| 4,134,045 | 1/1979 | Quin | 439/502 |
| 4,708,663 | 11/1987 | Eckart | 439/502 |
| 4,844,029 | 7/1989 | Suzuki | 219/205 |

*Primary Examiner*—Paula A. Bradley
*Attorney, Agent, or Firm*—Harness, Dickey & Pierce

[57] ABSTRACT

A modular electrical power cord system that finds particular utility for use in truck engines having at least two engine block heaters. A primary cord is used with one of a plurality of different jumper cords whose length most closely matches the distance between the heaters.

14 Claims, 3 Drawing Sheets

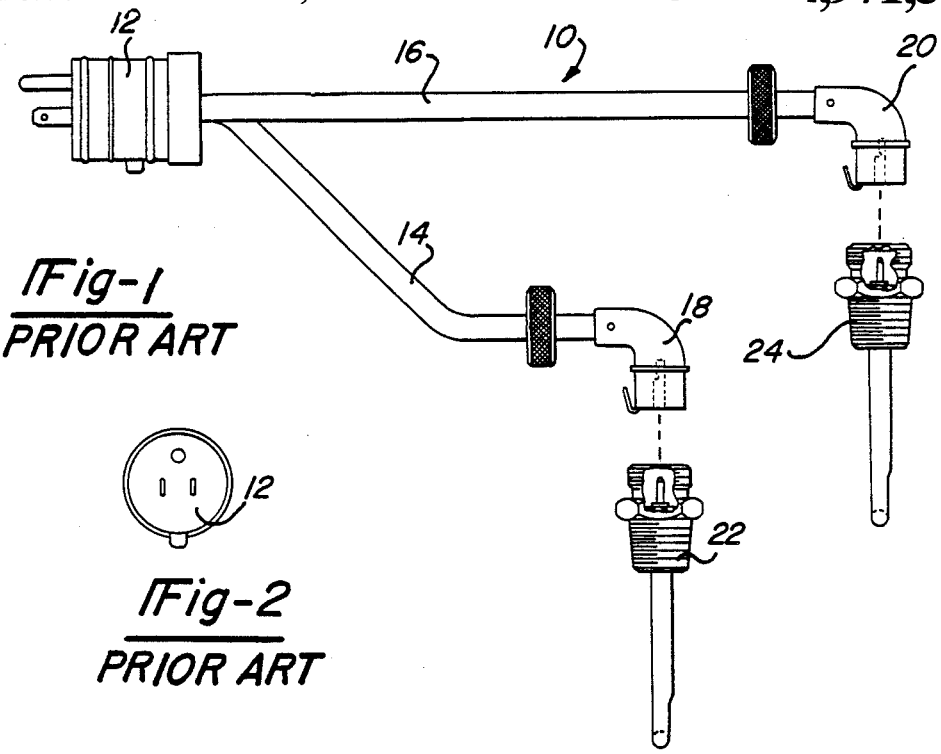
Fig-1
PRIOR ART
Fig-2
PRIOR ART
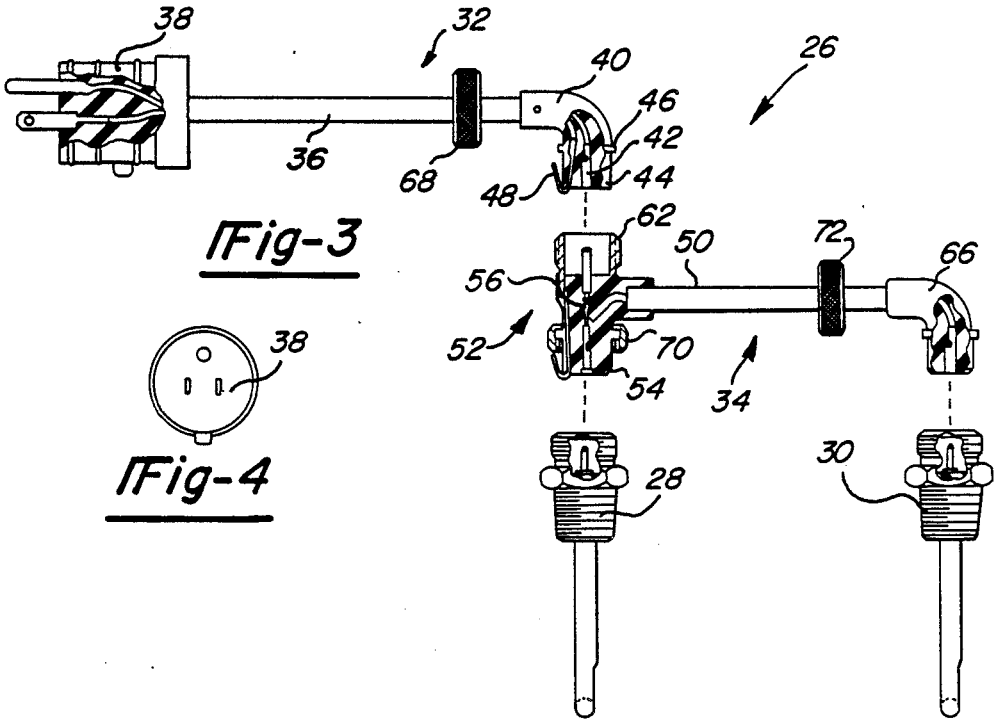
Fig-3
Fig-4

MODULAR POWER CORD SYSTEM

BACKGROUND OF THE INVENTION

1. Technical Field

This invention relates to electrical wiring and, more particularly, to power cords of the type that can supply energy to devices such as engine block heaters.

2. Discussion

Two or more engine block heaters are often used in truck engines to elevate temperatures of fluids in the engine during cold weather. Sometimes only one heater is used but it is usually wired in series with a thermostat that automatically regulates the on/off cycle of the heater. In either event, power must be supplied to the devices.

FIGS. 1 and 2 illustrate a conventional prior art technique for supplying electrical power to a pair of such devices. A Y-shaped power cord 10 includes an electrical plug 12 at one end of a pair of wiring cables 14 and 16. The opposite ends of cables 14 and 16 include female connectors 18 and 20, respectively. Connectors 18 and 20, in turn, are connected to engine block heaters 22 and 24, respectively, and supply electrical power to them.

While these so-called "Y-cords" have generally proved satisfactory, they have caused some economic problems to the cord manufacturer and, to a lesser extent, to the truck fleet owner or manufacturer who may own or make a variety of different trucks. This is because the spacing between heaters on one engine is often different from the spacing of the heaters on another type of engine. The distance to the electrical outlet may also differ from chassis to chassis. It is, of course, imperative that the power cord be long enough to reach each heater but it is also preferable to avoid any excess length in the cord. If the cord is longer than needed this can result in excess power loss from the energy source, not to mention the cumbersomeness of having to deal with excessive lengths of cable lying around.

In an attempt to obviate these problems, a large number of custom made Y-cords having different lengths were created. This solution unfortunately requires that the cord manufacturer produce and the truck fleet owner/manufacturer inventory a wide variety of different Y-cords, each having their unique product codes. In addition, some customers may want the two end connectors to be wired in series instead of parallel, thus, further aggravating the situation. This situation often arises when an owner wants to retrofit his vehicle with a thermostat controlled heater.

SUMMARY OF THE INVENTION

In accordance with the teachings of the present invention a modular building block system of electrical cords is provided for coupling at least two devices to a power source. A primary cord is used in conjunction with one of a plurality of different jumper cords of appropriate length or series/parallel configuration. In the preferred embodiment, each jumper cord has a dual connector on one end of the cable that is removably connected to an end connector on the primary cord. The dual connector is also connected to one of the devices. An end connector is also provided on an opposite end of the jumper cable which is removably coupled to the other device.

The cord manufacturer can make several different primary and jumper cables of different lengths and series/parallel configurations. A power cord combination which is appropriate for the customer's needs can easily be assembled from the primary and jumper cords having the desired lengths and/or configuration.

BRIEF DESCRIPTION OF THE DRAWINGS

The various advantages of the present invention will become apparent to those skilled in the art after reading the following specification and by reference to the drawings in which:

FIG. 1 is a side view of a PRIOR ART Y-cord for supplying power to two engine block heaters;

FIG. 2 is an end view of the Y-cord plug;

FIG. 3 is an exploded side view of a modular system of electrical cords made in accordance with the preferred embodiment of this invention;

FIG. 4 is an end view of the plug;

DESCRIPTION OF THE PREFERRED EMBODIMENTS

Figure 5:
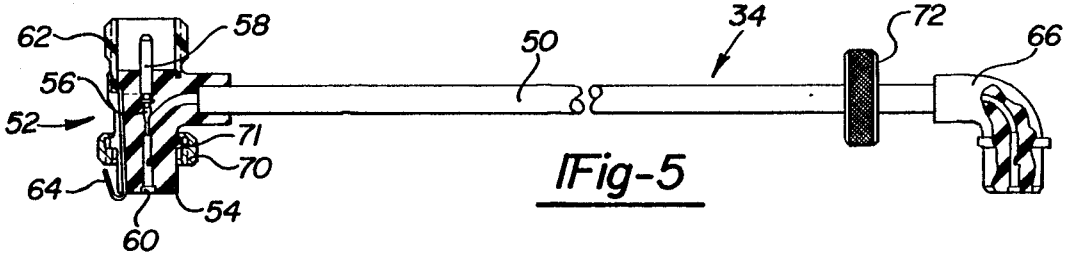
FIG. 5 is a side view of a jumper cord with parts in cross section.

It should be noted from the outset that while this invention will be described in connection with a particular example, the scope of the invention should not be so limited. For example, it is believed that the present invention has applicability for use in situations where any two devices need to be coupled to a power source and where the cable manufacturer and end user face substantially the same problems as described herein.

With that caveat in mind, the present invention will be described in connection with supplying power to a pair of engine block heaters. When two or more heaters are used on an engine, they are generally coupled together in parallel. In other applications only one heater is used but it is to be wired in series with a thermostat. The present invention accommodates both of these situations as will appear from the following description.

Turning now to FIGS. 3 and 4, a modular cord system 26 is shown for supplying power to two engine block heaters 28 and 30. The modular system 26 employs a primary cord 32 and one of a plurality of different jumper cords 34. The jumper cords are made in various lengths to accommodate different spacings between the heaters 28 and 30. The jumper cords 34 are also produced with either a series or parallel connection. In FIG. 3, the jumper cord 34 is provided with a parallel connection since two heaters are to be powered and the length of the jumper cord 34 is chosen to be substantially the same length as the distance between the heaters 28, 30. Although not as critical to the overall teachings of the present invention, the primary cord 32 can likewise be produced in various lengths.

Each primary cord 32 preferably has a three wire (grounded) cable 36 with a typical three wire-grounded weatherproof male plug 38 on one end. Plug 38 is designed to be inserted in an electrical receptacle that provides electrical energy to the devices to be powered. The opposite end of the cable 36 has an end connector 40 thereon. The end connector has a pair of female receptacles 42, each one being connected to one of the wires in the cable 36. The two receptacles 42 are held in an insulative body 44 having a transversely extended shoulder 46. A reversely bent ground tab 48 extends from the body 44 and is connected to the ground wire in the cable 36. Thus, power is supplied from the male prongs on plug 38 over the wires in cable 36 to the female receptacles 42 in end connector 40.

Figure 6:
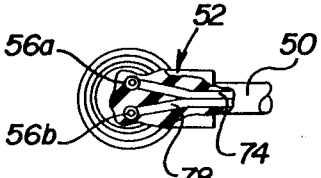
FIG. 6 is a top view with parts in cross section of the dual connector used in the jumper cord of FIG. 5.

FIGS. 5 and 6 show the construction of a typical jumper cord 34 in more detail. Cord 34 includes a wiring cable 50 containing at least two but preferably three wires therein to provide a grounded connection. As noted above, the length of the cable 50 will differ from jumper cord to jumper cord. Typically, one set of parallel wired jumper cords will be made between lengths of about one foot to six feet at increments of about one foot. Another set will be made of similar incremental lengths but wired in series. As will appear, each jumper cord is substantially identical in construction except for some minor details.

Each jumper cord 34 includes a T-shaped dual connector which is generally designated by the numeral 52. It includes an insulative body 54 having a top arm, a bottom arm and a side leg. Body 54 can be made of any suitable insulating material such as vinyl, silicon rubber or other suitable moldable material. A pair of terminal pins 56 are held in the body 54. The top of each terminal pin is in the shape of a male post 58 that engages the female receptacle 42 in end connector 40. The lower portion of the terminal pin 56 terminates in a female receptacle 60. An externally threaded adapter or ferrule 62 surrounds the male posts 58. A ground tab 64 extends through body 54 and makes electrical connection to the ferrule 62. Thus, it can be appreciated that the lower arm portion of the dual connector 52 is of substantially similar construction as the end connector 40 on the primary cord 32. Likewise, the opposite end of cable 50 is provided with an end connector 66 of similar construction. The female connector 40, the lower arm portion of dual connector 52 and end connector 66 each include a rotatable internally threaded nut 68, 70 and 72, respectively. Nuts 68 and 72 are designed to slide over their respective end connectors and rest on their shoulders 46. Nut 70 can rotate but is held axially in place by projection 71.

Figure 7:
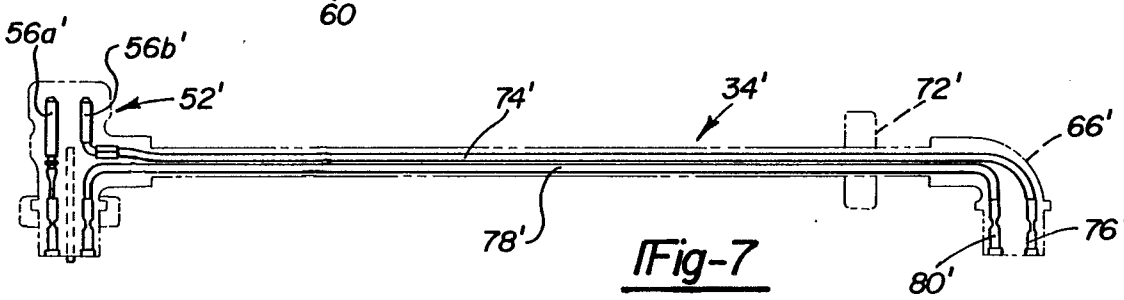
FIG. 7 schematically illustrates a jumper cord in which the dual connector and end connector are wired in series.
Figure 8:
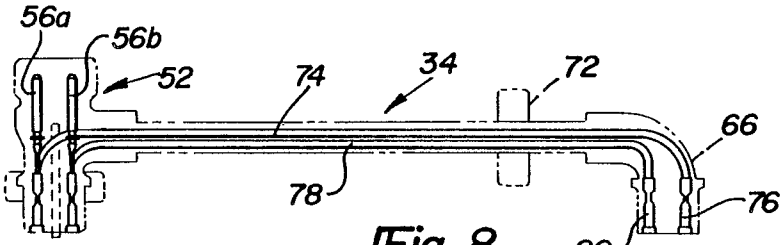
FIG. 8 schematically illustrates an alternative jumper cord having a cable of a different length and with the connectors wired in parallel.

FIGS. 7 and 8 illustrate the difference in wiring between a series-wired jumper cord 34' (FIG. 7) and a parallel-wired jumper 34 (FIG. 8). In the series-wired jumper cord 34', the terminal pin **56*b'* is broken into two parts. The other terminal pin 56*a'* is unbroken. One wire 74' connects the top part of terminal 56*b'* to a female receptacle 76' in end connector 66'. Another wire 78' connects the other female receptacle 80' to the lower or female part 82' of terminal pin 56*b'*. In contrast, terminal 56*b* is not broken in the parallel-wired jumper cord 34 shown in FIG. 8. In this embodiment, wire 74 connects terminal pin 56*a* to female receptacle 76 in end connector 66. Wire 78, on the other hand, connects the entirety of terminal pin 56*b* to the female receptacle 80**. The ground connection (not shown) is made between the two connectors in a conventional manner.

Figure 9:
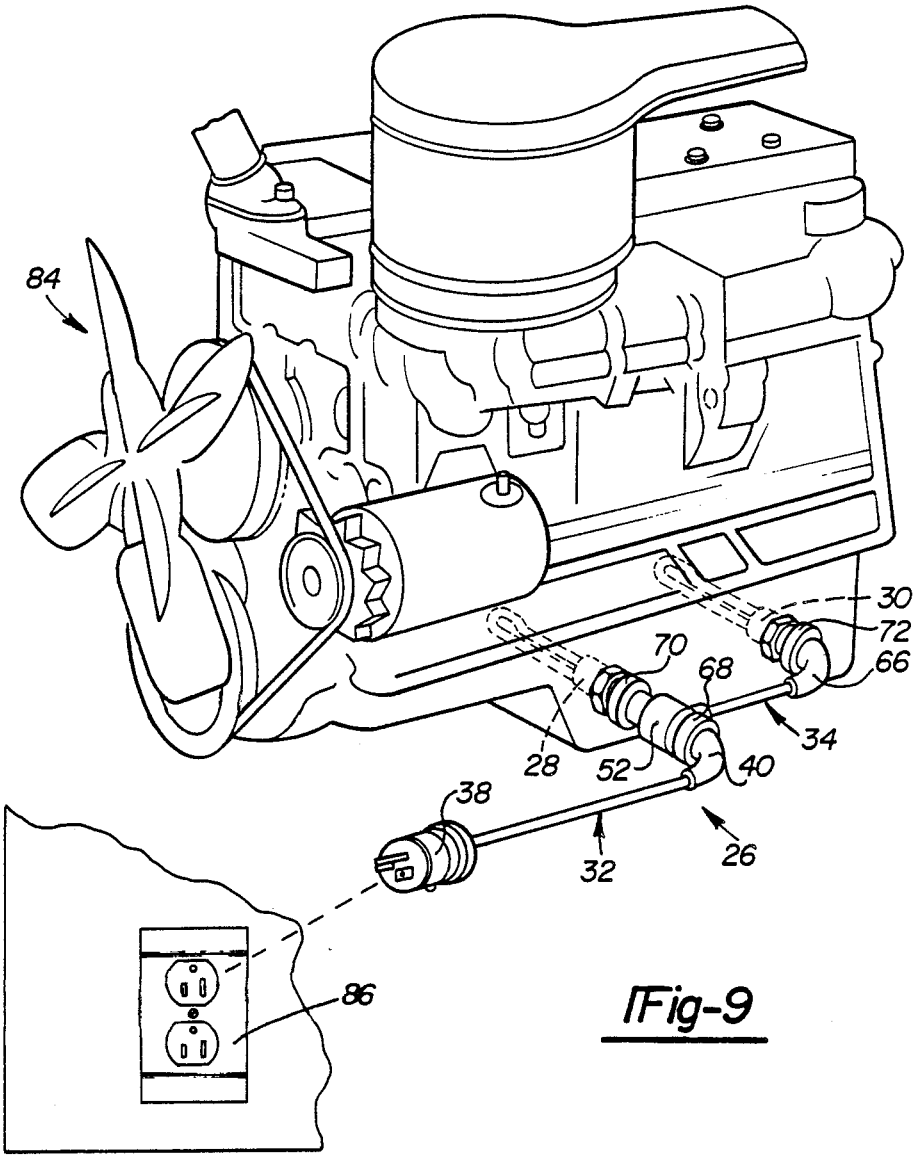
FIG. 9 illustrates the preferred embodiment of this invention in typical use providing power to two engine block heaters.

FIG. 9 is useful in understanding the method of the present invention. An engine 84 is shown with a pair of heaters 28 and 30 mounted to the oil pan. The heaters 28 and 30 can be of any conventional type such as heavy duty frost plug heaters, plate types or the externally threaded types illustrated in these drawings which are screwed into the engine 84.

Assume, for example, that the spacing between heaters 22 and 24 is about two feet. The truck fleet owner can measure this distance and convey this information to the power cord manufacturer. The truck fleet owner also indicates that the two devices should be wired in parallel and that the electrical receptacle 86 is located about ten feet from the usual parking location of the truck. The cord manufacturer uses this data and selects a primary cord 32 of appropriate length, as well as a parallel-wired jumper cord 34 of the appropriate length. The jumper cord 34 is mated to the primary cord 32 by inserting the end connector 40 into the top portion of the dual connector 52. The nut 68 is then slid over end connector 40 and engages the external threads on ferrule 62. Rotation of the nut 68 draws the end connector 40 into the dual connector 52 thereby making both the appropriate physical and electrical connection.

The combination primary/jumper cord assembly is then ready for shipment to the ultimate end user. The end user therefore has obtained all of the advantages of a custom made power cord that is specifically adapted for his particular engine. The user interconnects the lower half of the dual purpose connector 52 with heater 28 by engaging female receptacles 60 with the male pins in the heaters. The interconnection is secured by rotating the cord nut 70 so as to engage the external threads on the upper potion of the heater thereby drawing the two parts together. A similar connection is made between the end connector 66 on the jumper cord 34 and the other heater 30. Since the length of the jumper cord 34 is substantially the same as the distance between the two heaters, power loss is minimized and other problems associated with excessive cable lengths are avoided. Thus, the end user is satisfied and the cable manufacturer reaps the advantages of lower manufacturing and inventory costs due to the inventive modular approach. Advantages of this invention also flow to the original equipment manufacturer (OEM) of different trucks, as well as to the end user who may desire to retrofit his vehicle with a series connected thermostat. The OEM can stock different primary cords and jumper cords and then mix/match them as necessary for a particular engine and chassis design. The retrofitting end user can salvage his old heater cord (which may be similar to the primary cord 32) and use it together with the inventive series connected jumper cord 34 to connect the thermostat to the existing heater.

Those skilled in the art will come to appreciate that there are various other advantages of the present invention after a study of the specification, drawings and following claims.

What is claimed is:

1. A modular system of electrical power cords for coupling at least two devices to a power source, said system comprising:

a primary cord having a wiring cable with first and second connectors at opposite ends thereof, the first connector being coupled to the power source;

a first jumper cord having a wiring cable of a preselected length associated with the distance between the two devices, dual connector means on one end of the cable removably connected to the second connector of the primary cord, said dual connector means also being connected to one of the devices, the jumper cord further including an end connector on an opposite end of the cable which is removably coupled to the other device; and an alternative jumper cord having a different length than the first jumper cord, the alternate jumper cord being substituted for the first jumper cord when the devices to be connected are spaced apart by a distance more closely related to the length of the alternative jumper cord than the first jumper cord.

2. The system of claim 1 wherein the dual connector means and end connector on the jumper cord are connected to a pair of heaters located in an engine.

3. The system of claim 1 wherein the first jumper cord provides a parallel electrical connection between the dual connector means and the end connector; and wherein the alternative jumper cord provides a series electrical connection between the dual connector and the end connector thereon.

4. The system of claim 1 wherein said dual connector means is generally T-shaped having a leg portion and a pair of arm portions, said end connector of the primary cord being removably connected to one arm portion, said one device being removably connected to the other arm portion, and said wiring cable extending from the leg portion.

5. The system of claim 1 wherein said dual connector means comprises:

an insulative body;

a pair of terminal pins in the body, one end of each pin providing a male post and an opposite end providing a female receptacle;

a threaded ferrule surrounding the male posts;

a nut surrounding the female receptacles; and electrical wiring connected to the pins and extending from a side of the body.

6. The system of claim 5 wherein the jumper cord wiring cable includes at least two wires; and wherein said terminal pins in the first jumper cord extend through the body and are connected in parallel to the end connector; and wherein one of the terminal pins in the alternative jumper cord is broken into a top and bottom part, one end of a wire being connected to the top part and connected at its opposite end to a receptacle in said end connector, the other wire being connected between the bottom part and another receptacle in the end connector thereby providing the alternative jumper cord with a series connection.

7. The system of claim 5 wherein said end connectors comprise:

a pair of hollow female receptacles;

a sleeve surrounding the receptacles, said ferrule having a shoulder; and nut means for engaging threads on the ferrule of the dual connector means or threads on the devices, said nut means securing the end connectors to the dual connector means or to the devices.

8. The system of claim 7 which further comprises:

ground tab means connected to the ferrule and extending through the body of the dual connector means for providing an electrical ground connection to one of the devices.

9. A method of providing electrical power cords for use with a variety of different machines, each machine having at least two devices to be provided with electrical power, the devices of one machine being spaced apart a different distance than the devices on another machine, said method comprising:

providing a primary cord having a plug at one end of a wiring cable and an end connector at an opposite end thereof;

providing a first jumper cord having a dual connector at one end of a wiring cable of a given length and an end connector at an opposite end thereof;

providing a plurality of interchangeable alternative jumper cords of different lengths than the first jumper cord;

determining the distance between the devices to be powered on a given machine;

selecting a jumper cord having a length similar to said distance;

coupling the dual connector of the selected jumper cord to the end connector of the primary cord;

coupling one device to the dual connector;

coupling the other device to the end connector on the selected jumper cord; and plugging the plug into an electrical receptacle to thereby provide power to the two devices.

10. The method of claim 9 wherein the devices are engine heaters.

11. The method of claim 10 wherein said selected jumper cord provides a parallel electrical connection between the engine heaters.

12. The method of claim 9 wherein one device is an engine heater and the other device is a thermostat.

13. The method of claim 12 wherein said selected jumper cord provides a series electrical connection between the dual connector and end connector.

14. The combination comprising:

an engine;

at least two heaters in the engine which are spaced apart by a given distance;

an electrical receptacle means for providing electrical energy;

a primary power cord having a wiring cable with a plug at one end and an end connector at an opposite end, said plug being engaged with the electrical receptacle;

a jumper cord having a wiring cable with a length associated with the distance between the heaters, a dual connector at one end of the cable and an end connector at an opposite end of the cable, the dual connector being removably connected to the end connector of the primary cord as well as to one of the heaters, the end connector of the jumper cord being connected to the other heater; and whereby jumper cords of substantially the same construction but of different lengths can be interchangeably used with the primary cord to provide power to different engines where the heaters are spaced apart by different distances.

* * * * *